US007517112B2

(12) United States Patent
Miletich et al.

(10) Patent No.: US 7,517,112 B2
(45) Date of Patent: Apr. 14, 2009

(54) TOP RELAMPING SYSTEM

(75) Inventors: Don Miletich, Franklin, WI (US); Brian L. Kinnune, Racine, WI (US)

(73) Assignee: Ruud Lighting, Inc., Racine, WI (US)

( * ) Notice: Subject to any disclaimer, the term of this patent is extended or adjusted under 35 U.S.C. 154(b) by 180 days.

(21) Appl. No.: 11/478,818

(22) Filed: Jun. 30, 2006

(65) Prior Publication Data

US 2008/0002406 A1 Jan. 3, 2008

(51) Int. Cl.
*F21V 21/26* (2006.01)

(52) U.S. Cl. ..... 362/269; 362/382

(58) Field of Classification Search ..... 362/365, 362/147, 148

See application file for complete search history.

(56) References Cited

U.S. PATENT DOCUMENTS

| | | | | |
|---|---|---|---|---|
| 4,175,282 | A | 11/1979 | Grindle et al. | |
| 4,323,953 | A | 4/1982 | Hutchison | |
| 4,437,142 | A | 3/1984 | Donato et al. | |
| 4,475,147 | A * | 10/1984 | Kristofek | 362/148 |
| 4,498,126 | A | 2/1985 | Hernandez | |
| 4,628,423 | A | 12/1986 | Ogle | |
| 5,309,342 | A | 5/1994 | Heinen, Sr. | |
| 5,704,710 | A | 1/1998 | Greene et al. | |
| 5,727,871 | A | 3/1998 | Kotloff | |
| 5,921,655 | A * | 7/1999 | Nassim | 362/147 |
| 5,951,151 | A | 9/1999 | Doubeck et al. | |
| 6,152,571 | A * | 11/2000 | Ruiz | 362/101 |
| 6,227,681 | B1 | 5/2001 | Shoemaker et al. | |
| 6,439,741 | B1 | 8/2002 | Diaz et al. | |
| 6,505,960 | B2 | 1/2003 | Schubert et al. | |
| 6,554,457 | B1 | 4/2003 | Platt | |
| 6,752,520 | B2 * | 6/2004 | Vernusset et al. | 362/365 |
| 6,773,136 | B2 * | 8/2004 | Reinert, Sr. | 362/153 |
| 2008/0002406 | A1 * | 1/2008 | Miletich et al. | 362/269 |

* cited by examiner

*Primary Examiner*—Anabel M Ton
(74) *Attorney, Agent, or Firm*—Jansson Shupe & Munger Ltd.

(57) ABSTRACT

A lighting fixture includes a base having a hole in a top surface thereof, at least one retaining member disposed on the top surface of the base proximate the hole, a lamp housing having a top portion and a dome-shaped bottom portion, the bottom portion including a perimeter portion having an essentially planar annular end surface sized to surround the hole, at least one boss extending from the perimeter portion of the lamp housing, and a handle attached to the top portion of the lamp housing, where the retaining member is structured for receiving the boss with the annular end surface of the lamp housing abutting the top surface of the base and surrounding the hole, so that rotation of the handle effects twist-locking attachment or detachment of the lamp housing respectively to or from the base by rotating the boss into or out of engagement with the retaining member.

20 Claims, 8 Drawing Sheets

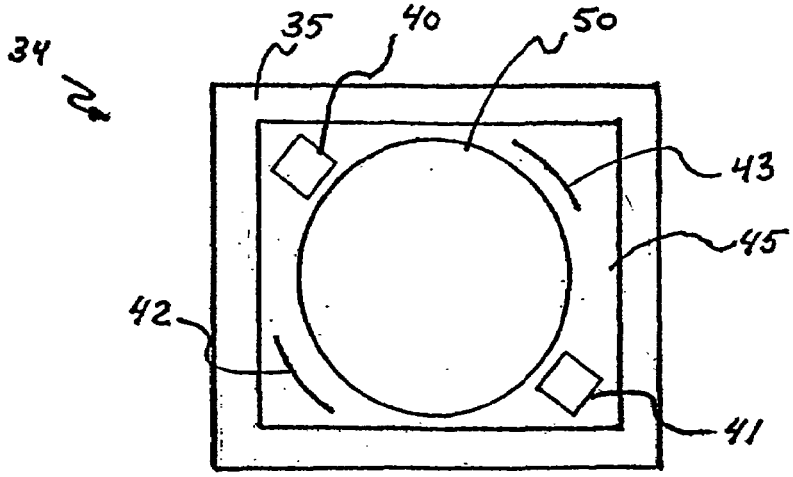
FIG. 2
FIG. 7A
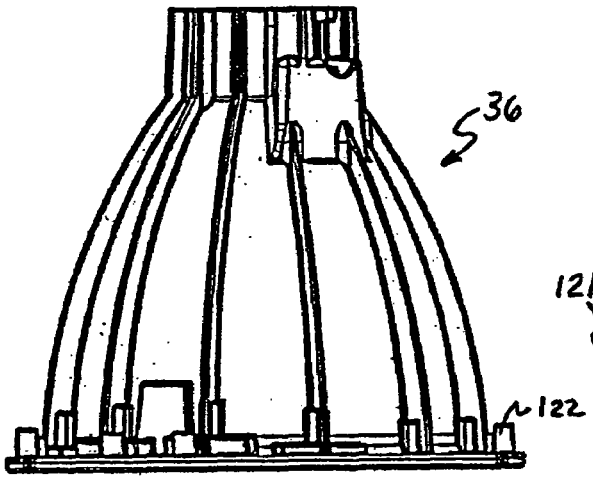
FIG. 7B
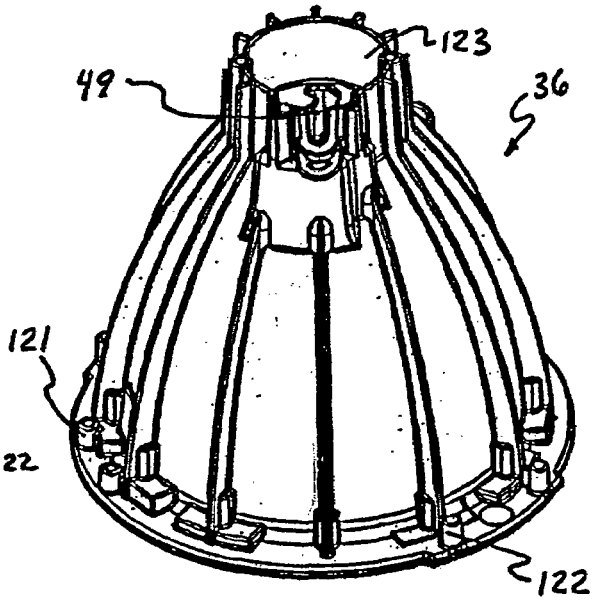

TOP RELAMPING SYSTEM

FIELD OF THE INVENTION

The invention relates to servicing of installed lighting fixtures and, more particularly, to a structure and method that improves serviceability by simplifying access to lighting fixture components.

BACKGROUND OF THE INVENTION

Industrial and commercial lighting fixtures are known that include a housing having at least one lamp and corresponding lamp socket(s) disposed therein and having a structure adapted for being installed in a ceiling or above a large area. Such lighting fixtures may typically also secure various associated electrical components, for example, ballasts, switches, sensors, etc. The supporting structure may include a frame adapted for mounting the various components along with one or more reflectors.

A given lighting fixture may be mounted in locations where relamping is difficult. For example, the lighting fixture may be located high above the floor or may be a recessed type fixture where service access from below the fixture is difficult. Such exemplary situations include lighting in a church, above a display area, in a sports arena, in a hazardous area, and others. As used herein, the term "relamping" is defined as the replacement of a lamp.

Conventional structures and methods have been used for simplifying a relamping being performed in a safe manner. However, such structures and methods only consider relamping from beneath a lighting fixture. In particular, such structures and methods do not provide for safe relamping from above a lighting fixture.

OBJECTS OF THE INVENTION

It is an object of the invention to provide an improved relamping system overcoming some of the problems and shortcomings of the prior art, including those referred to above.

Another object of the invention is to provide a top relamping system that allows a worker to avoid any high voltage wiring when relamping.

Another object of the invention is to provide a top relamping system that reduces a risk of a hot lamp being dropped when being removed from a lamp socket.

Still another object of the invention is to provide a relamping system that reduces a risk of eye injury.

Yet another object of the invention is to provide a relamping system that requires no tools.

Another object of the invention is to provide a modular lighting system adapted for top relamping, and having improved heat dissipation properties.

How these and other objects are accomplished will become apparent from the following descriptions and the drawings.

SUMMARY OF THE INVENTION

According to an aspect of the invention, a lighting fixture includes a base having a hole in a top surface thereof, a lamp housing having a top portion and a dome-shaped bottom portion, the bottom portion including a perimeter portion having an essentially planar annular end surface sized to surround the hole, at least one boss extending from the perimeter portion of the lamp housing, at least one retaining member disposed on the top surface of the base proximate the hole and structured for receiving the boss with the annular end surface of the lamp housing abutting the top surface of the base and surrounding the hole, and means for rotating the lamp housing, thereby effecting twist-locking attachment/detachment of the lamp housing to/from the base by rotating the boss into/out of engagement with the retaining member.

According to another aspect of the invention, a method of servicing a lighting fixture includes providing a base having a hole in a top surface thereof, providing a lamp housing having a longitudinal axis, a top portion and a dome-shaped bottom portion, the bottom portion including a perimeter portion having an essentially planar annular end surface sized to surround the hole, providing at least one boss extending from the perimeter portion of the lamp housing, providing at least one retaining member disposed on the top surface of the base proximate the hole and structured for receiving the boss with the annular end surface of the lamp housing abutting the top surface of the base and surrounding the hole, and rotating the lamp housing about its longitudinal axis, thereby rotating the boss into or out of engagement with the retaining member and effecting twist-locking attachment/detachment of the lamp housing to/from the base.

According to a further aspect of the invention, a method of relamping a lighting fixture includes providing a base having a hole in a top surface thereof, providing a lamp housing with a bottom surface that rests on the top surface of the base and surrounds the hole, the lamp housing having a top portion and a handle secured to the top portion, the lamp housing having a socketed lamp disposed therein, providing a twist-lock apparatus for rotatably locking the lamp housing to the base, twisting the handle counter-clockwise, thereby unlocking the lamp housing from the base, lifting the lamp housing by the handle and positioning the lamp housing so that the lamp may be accessed from a user position above the top surface of the base, replacing the lamp, lowering the lamp housing having a replaced lamp onto the base using the handle, and twisting the handle clockwise, thereby locking the lamp housing to the base.

As will be apparent, the terms "top" and "bottom" (e.g., "top surface" and "bottom surface") are used for convenience to refer to an orientation of a preferred embodiment where the lighting fixture is positioned with its reflector opening toward the floor of a facility.

The foregoing summary does not limit the invention, which is defined by the attached claims. Similarly, neither the Title nor the Abstract is to be taken as limiting in any way the scope of the disclosed invention.

BRIEF DESCRIPTION OF THE DRAWING FIGURES

FIG. 2 is a schematic top view of the light support of FIG. 1.

Figure 7C:
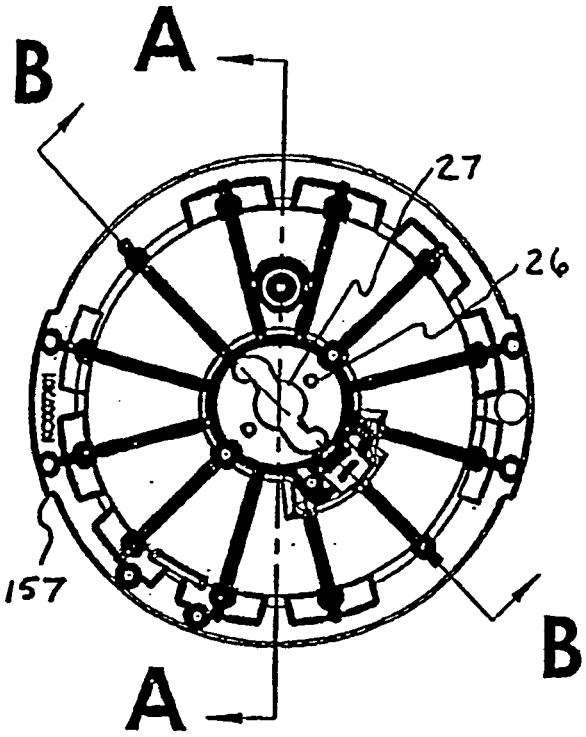
Figure 7D:
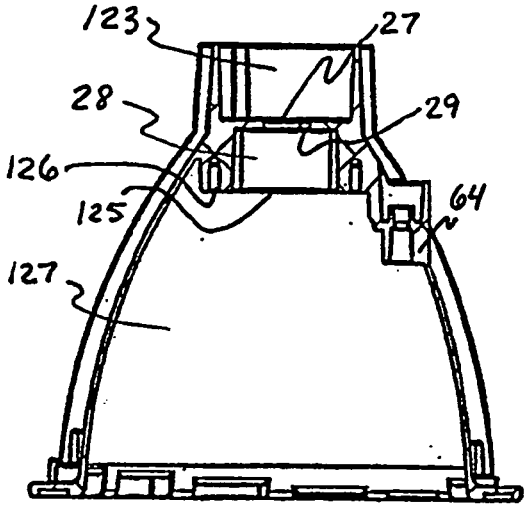
Figure 7E:
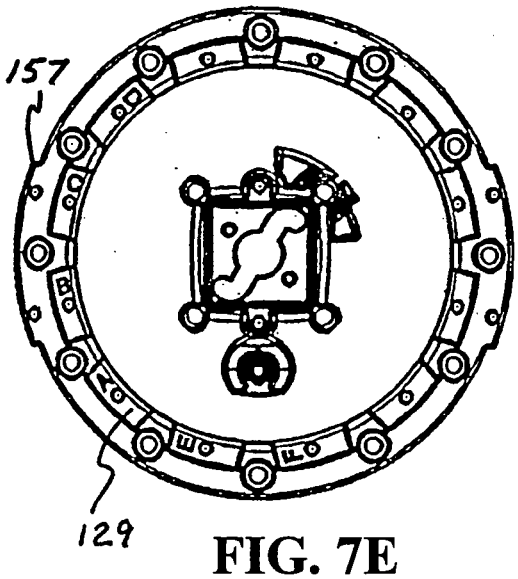
Figure 7F:
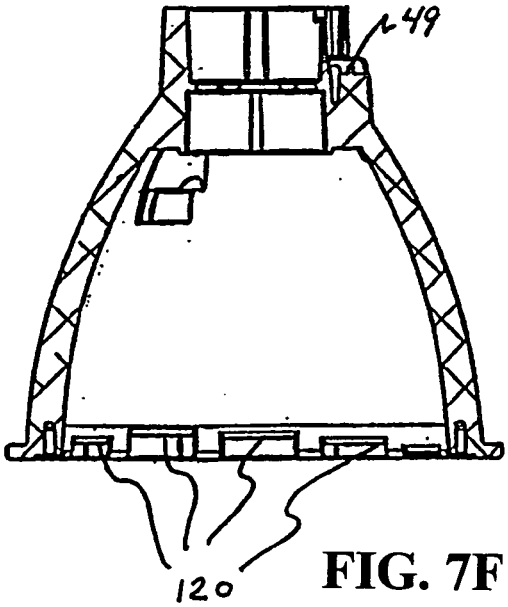

FIGS. 7A-7F respectively show, for a lamp housing, a side elevation view, a perspective view, a top view, a view along the line A-A of FIG. 7C, a bottom view, and a view along the line B-B of FIG. 7C, according to an exemplary embodiment of the invention.

FIGS. 8A-8K show different views and configurations for a socket assembly having improved heat dissipation and universality of configuration, according to exemplary embodiments of the invention.

Figure 9:
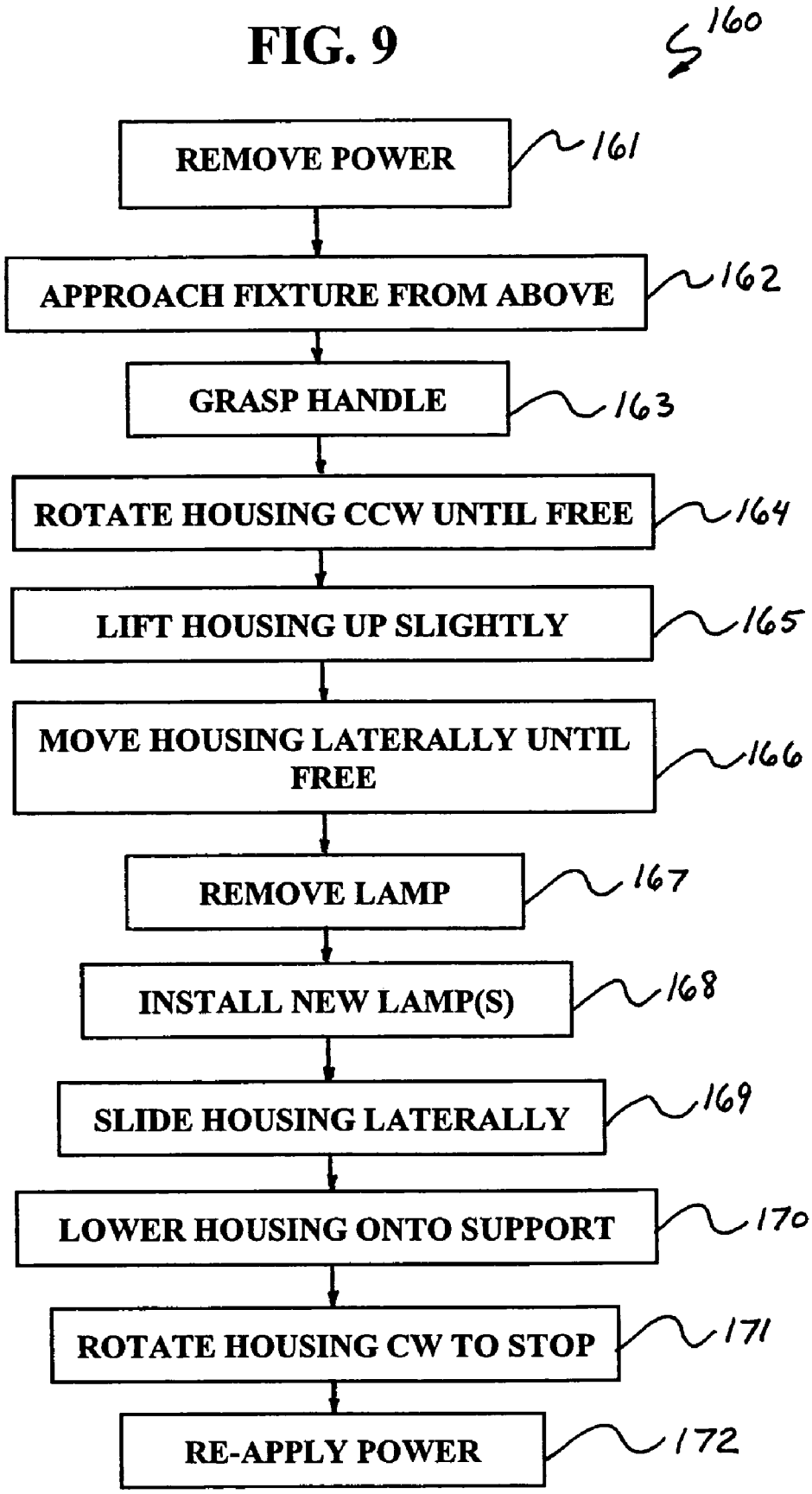

FIG. 9 is a flowchart for a method of re-lamping a light fixture, according to an exemplary embodiment of the invention.

DETAILED DESCRIPTION OF PREFERRED EMBODIMENTS

Figure 1:
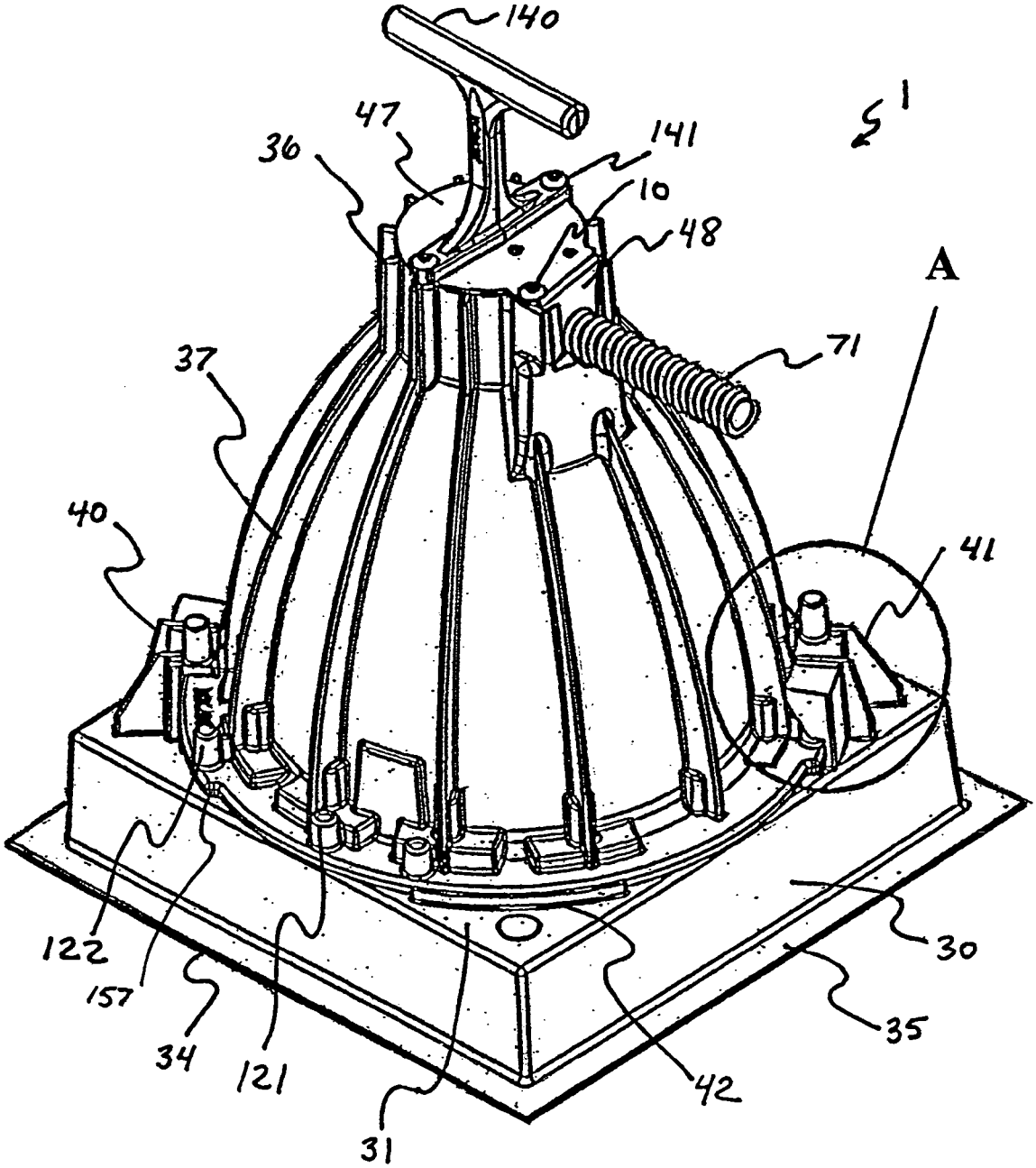
FIG. 1 is a perspective view of a light fixture adapted for relamping from above, in a locked position, according to an exemplary embodiment of the invention.

FIG. 1 is a perspective view of an exemplary light fixture 1 adapted for relamping from above. Fixture 1 has a light support member 34, preferably formed by casting a metal such as aluminum or other suitable metal into a box-like structure having side walls 30, a top surface 31, and flanges 35 formed on all four sides of light support member 34. FIG. 2 is a partial schematic top view of light support 34. Light support member 34 is adapted for attaching a lamp housing 36 to an abutment surface 45. In the illustrated example, light support 34 has curved guide projections 42, 43 formed to assist installation of lamp housing 36 onto light support 34. Integrally formed position and rotation guide projections 42, 43 are curved portions that have a same curvature as that of the mounting surface of lamp housing 36 and that are disposed to allow lamp housing 36 to be precisely situated between guide projections 42, 43 and then fastened to light support 34 at the desired location. Additional alignment structure may be provided for securing lamp housing 36 at a predetermined or selected position, for example one or more twist-lock stop and leaf spring mounts 40, 41 that are an integrally cast part of light support member 34. Light support 34 may be affixed in various ways to structure such as rafters, framework, and others, by use of conventional mounting hardware known to those skilled in the art. A light support may be formed as a base structure having different shapes and configurations, such as row mounting, flat low profile mounting, etc.

Lamp housing 36 is also preferably formed by casting a suitable metal such as aluminum, into a form having a domed shape and having additional metal volume, such as ribs 37, for increasing heat sinking and dissipation. Light support member 34 has a hole 50 of a same general shape as the bottom opening of the dome of lamp housing 36, so that light from lamp housing 36 passes therethrough. The mating surfaces between light support member 34 and lamp housing 36 are preferably flush with one another, thereby transferring heat therebetween for optimal heat dissipation. Twist-lock locking bosses 122 are also cast integrally for twist-lock type engagement with a corresponding locking stop boss assembly, as further described below. Mounts 121 are provided as an integral part of the casting for mounting any additional apparatus. A top cover plate 47 is mounted atop lamp housing 36, and has a top portion and a strain relief portion 48 adapted for securing conduit 71 to housing 36 for feeding electrical power to lighting fixture 1. A handle 140 is attached to housing 36 by two screws 141. Handle 140 may be used for twist locking and unlocking of lamp housing 36 from light support 34, as detailed below. Handle 140 may be formed in any number of ways, and preferably is an injection molded thermoplastic structure having a "T" shape that allows a worker to easily grasp and apply a twisting torque thereto, and having mounting provisions for being securely fastened to the top of lamp housing 36.

Although the above-described embodiment includes a handle for rotating lamp housing 36, thereby effecting twist-locking attachment or detachment of lamp housing 36 respectively to or from light support 34, any suitable means known to those ordinarily skilled in the art may be used for such rotating. For example, one or more integrally formed holes or loops (not shown) may be formed in lamp housing 36, so that a tool such as a rod may be inserted into the loop(s) and a service person can then move such a rod as a lever, thereby rotating lamp housing 36. In another example, notches (not shown) may be integrally formed in lamp housing 36 so that a clamp or attachable handle can be securely attached to the notches, and so that rotation of the clamp effects the rotating of the lamp housing. In another example, lamp housing 36 may have an integrally formed grip-able surface, such as a textured portion or ribs 37, on the dome shaped bottom portion of lamp housing 36, so that a service person can simply rotate the lamp housing 36 itself by grasping the grip-able surface, without a need for any separate structure to be provided for enabling the rotating.

Figure 4:
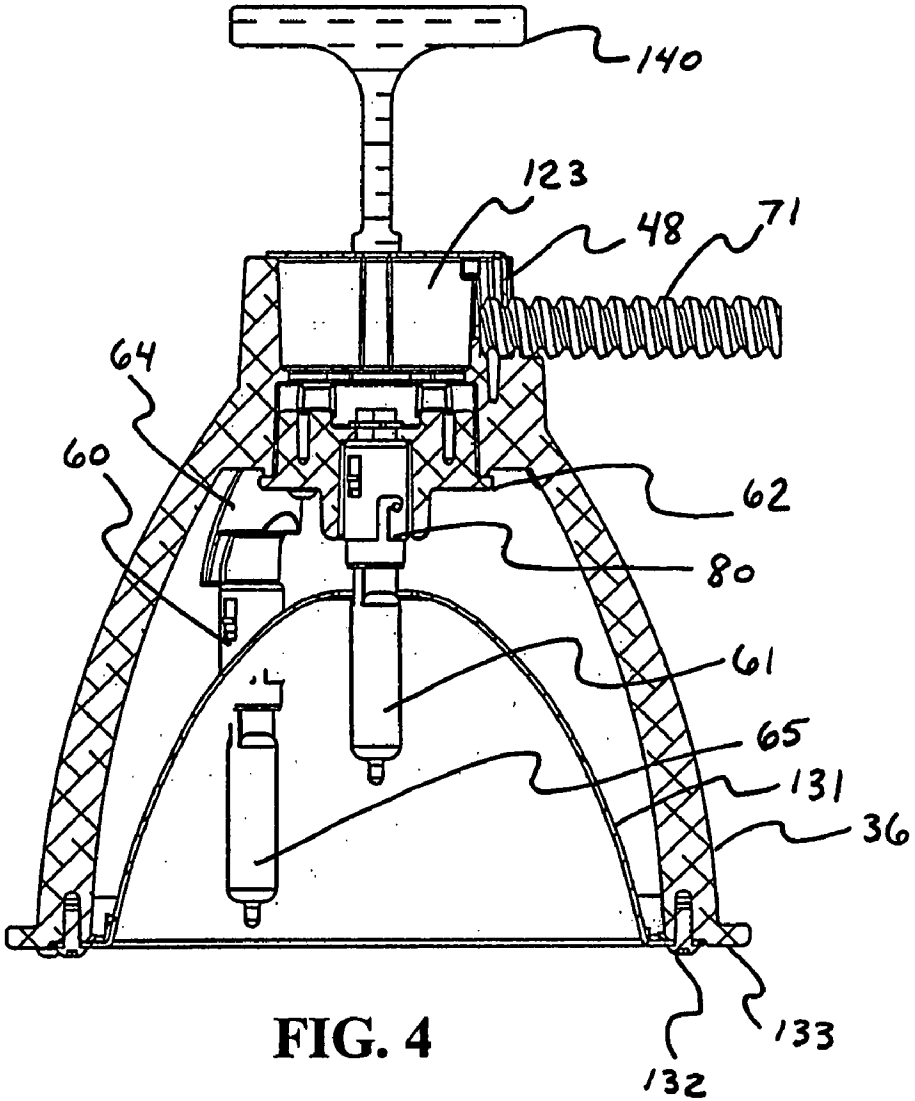
FIG. 4 is a cutaway side view of various components installed in and attached to a lamp housing, according to an exemplary embodiment of the invention.

FIG. 4 shows a lamp housing 36 with a socket assembly 62 having a same casting as that of housing 36, effecting efficient heat transfer therebetween. To effect such transfer, a flat perimeter surface 133 is provided as a flange around the end of the dome portion of lamp housing 36, for abutment with top surface 31 of light support 34. A reflector 131 is mounted to housing 36 using screws 132. Reflector 131 has a center hole that allows lamp 61 to pass therethrough, and has a hole in a sidewall portion that allows lamp 65 and socket 60 to pass therethrough. Such allows the lamps to remain static regardless of the distribution effected by reflector 131. Socket 60 is secured into the integrally cast portion secondary socket assembly 64, which has a wire passageway and a conduit mount for feeding electrical power to socket 60. The conduit 71 separately providing power to lamp 61 is locked into place between an integrally cast portion of lamp housing 36 and a strain relief portion 48 of cover plate 47. A top wiring compartment 123 allows for wiring connections and extra wire, and is described further below.

Cast lamp housing 36 may be configured to allow multiple light sources through use of integral mounting, bracketry, and cast socket mounting inserts. Housing 36 is preferably designed to keep the lamp light center(s) of lamp(s) mounted therein at a constant position at all times. The optical performance and distribution variances are created by mounting reflector 131 to chosen integral mounting steps 120. This allows a user to vary optical performance by simply moving or replacing (e.g., alternate reflective materials or shape) reflector 131. Such changes may be made from below fixture 1 without disassembling fixture 1. Housing 36 is adapted to accept various sockets and lamps. For example, a first casting is designed to be used for T4 quartz, T4/T6 metal halide, and Par 20 lamp sources. A second type casting removes the base socket mount to allow utilization of A19/BT15/Par30/Par38 incandescent, ED17/Par30L/Par38 HID, and PLT compact fluorescent sources. Cast lamp housing 36 also incorporates integral quartz restrike (QEM) socket and conduit mounting and integral power feed conduit locking to allow conduit feeds without any use of additional connectors. When using Par30/Par38 lamp sources, the secondary integral QEM mounting is used.

Figure 3:
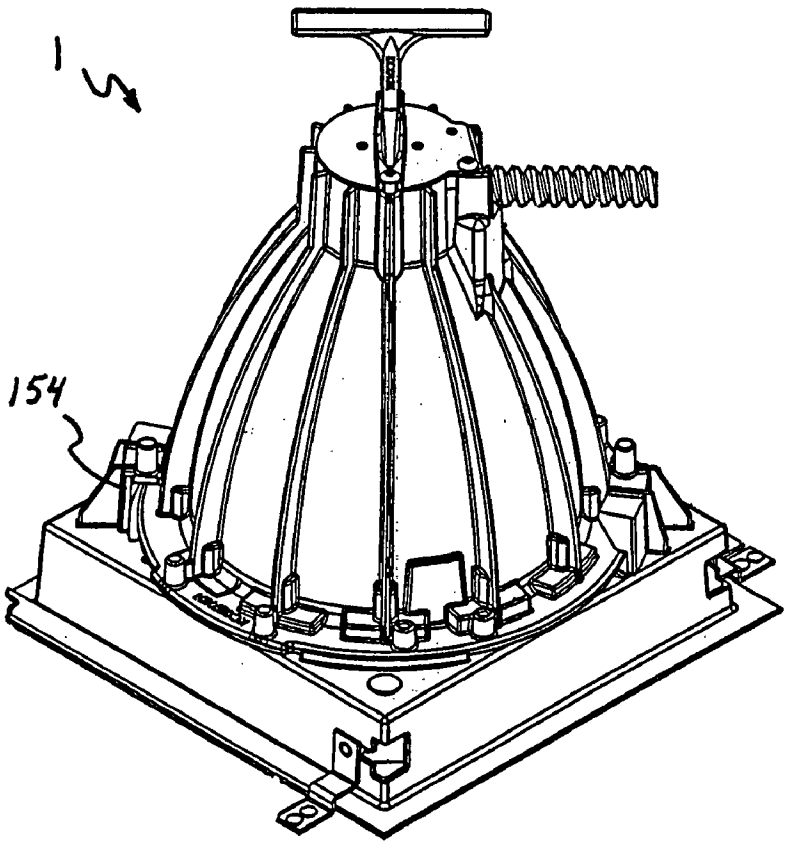
FIG. 3 is a perspective view of the light fixture of FIG. 1, in an un-locked position.
Figure 5:
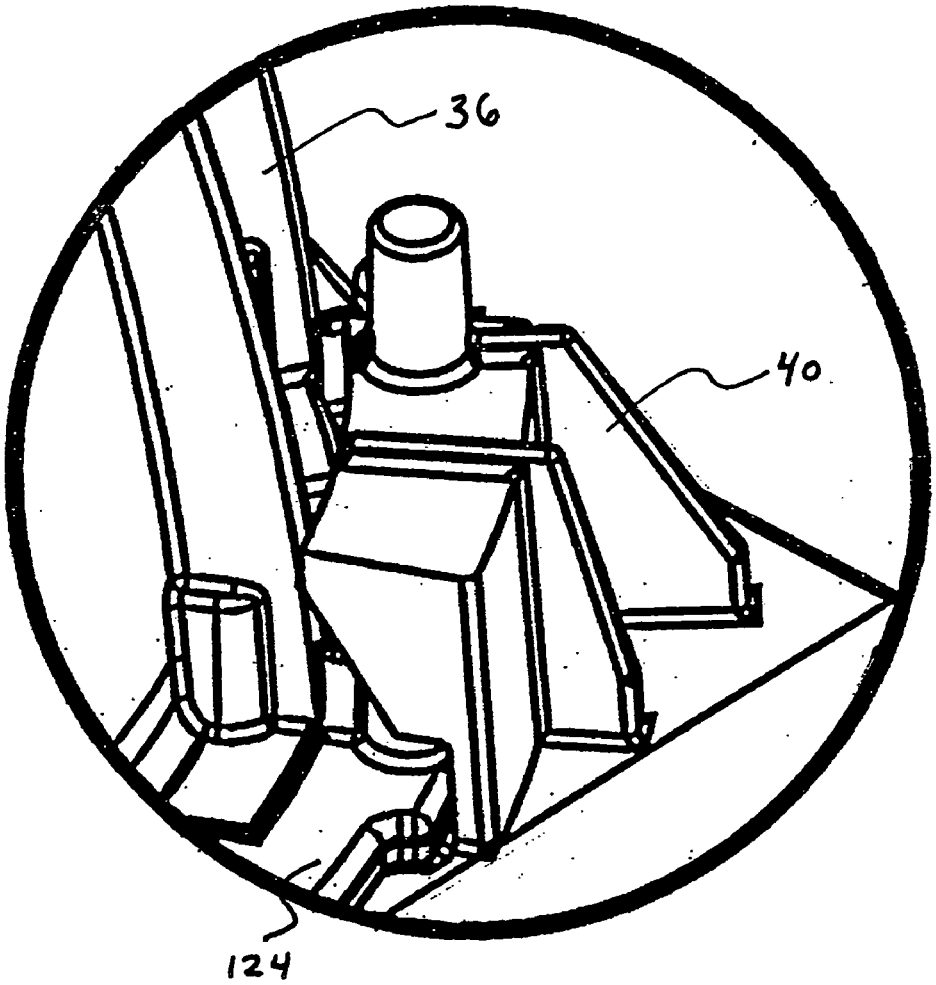
FIG. 5 is an enlarged view of the section of FIG. 1 labeled as "A."
Figure 6:
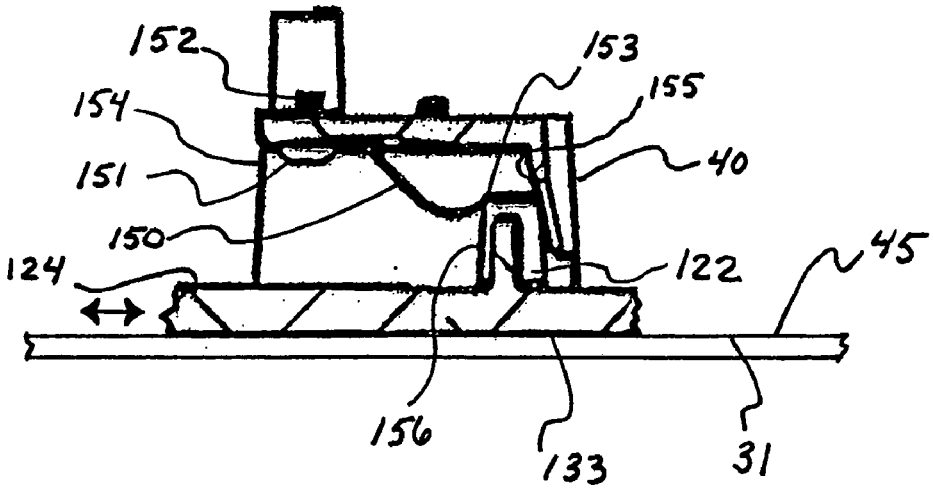
FIG. 6 shows an interior portion of a locking stop assembly securing a locking boss of a lamp housing, according to an exemplary embodiment of the invention.

FIG. 1 shows lamp housing 36 in an unlocked position and FIG. 3 shows lamp housing 36 in a locked position. FIG. 5 is an enlarged view of the section of FIG. 1 labeled as "A," and FIG. 6 shows an interior portion of a locking stop assembly 40 securing a locking boss 122 of lamp housing 36. A perimeter portion 124 of lamp housing 36 has a basic flange type form with a flat bottom surface 133 that sits on abutment surface 45 of top 31 of light support 34, in the area bounded by projections 42, 43. A leaf spring 150 is secured to an interior portion of locking stop assembly 40 with a screw 151 fastened into an integral screw boss 152. Leaf spring 150 has a distal end 153. As shown by the arrow in FIG. 6, when lamp housing 36 is rotated in a locking direction, perimeter portion 124 also rotates, which moves locking boss 122 into locking stop assembly 40 via entry end 154 As perimeter portion 124 travels further into locking stop assembly 40, locking boss 122 comes into contact with leaf spring 150 and pushes leaf spring 150 upward. Such causes some resistance to the turning of lamp housing 36. Finally, locking boss 122 hits an interior abutment end 155 of locking assembly 40 and end 153 of leaf spring 150 is allowed to drop slightly so that leaf spring end 153 "locks" against a trailing side 156 of locking boss 122, thereby snugly securing lamp housing 36 to light support 34. When lamp housing 36 is then rotated in an un-locking direction, an initial force is required to permit locking boss 122 to break free of leaf spring end 153 and additional force is required to compress leaf spring 150 with locking boss 122 until locking boss 122 is on an entry side of the apex of leaf spring 150.

The locking structure of fixture 1 effects a removable lamp housing that is securely and solidly engaged with a supporting structure, while allowing quick and easy removal without a need for tools or fasteners for holding the housing in place. In addition, reflectors and other hardware installed inside lamp housing 36 may be easily accessed after unlocking and removal of housing 36. The twist-locking of housing 36 to base 34 preferably includes a structure adapted for urging flat surface 133 against abutment surface 45 of top 31 of base 34. For example, leaf spring 150 urges lamp housing 36 downward.

FIGS. 7A-7F respectively show, for lamp housing 36, a side elevation view, a perspective view, a top view, a view along the line A-A of FIG. 7C, a bottom view, and a view along the line B-B of FIG. 7C. Quartz restrike mounts 121 are provided as an integral part of the casting for par lamp fixtures. Bosses 122 are also cast integrally. A top wiring compartment 123 is provided to allow for wiring connections and extra wire, and may include a strain relief section therein for securing conduit 71 thereto, or an integral power feed conduit lock 49 may be formed to combine with a strain relief portion 49 of top cover 47 for securing conduit 71, and either form may include locking screw boss(es). At the bottom of compartment 123 is an access hole 27 having a universal clearance pattern allowing different type sockets to be mounted in a first socket assembly space 28 and accommodate wiring thereto. For example, G-12 wiring and mounting of DC bayonet and mini-candelabra sockets may be accommodated completely within space 28. A mounting surface 29 within space 28 has integral screw bosses for securing such a socket assembly within space 28. The bottom walls of space 28 form an additional socket assembly mounting surface 125 that is laterally extended to include screw bosses 126, and such may be used for mounting a cast type socket assembly 62 where a heat conducting portion thereof is within space 28, and where a socket and surrounding portion extends into internal reflector space 127. Socket assembly 62 is further described below. A second socket mount assembly 64 is integrally cast in lamp housing 36, providing a direct mount conduit connection and knock-out wire access, and being adapted for receiving a quartz restrike DC bayonet type socket therein. The bottom perimeter surface of lamp housing 36 has an integral series of annularly arranged steps 120 for varying the vertical level of mounting of a reflector therewithin. Each step 120 has a corresponding screw hole for securing a mounting tab of a reflector thereto. Such allows an installer, service person, or customer to implement or change the light distribution by varying vertical reflector position. For ease of manufacturing assembly and field adjustment of the reflector assembly, step level markings 129 are provided to assure correct optical distributions by referencing the placement with a letter.

Figure 8A:
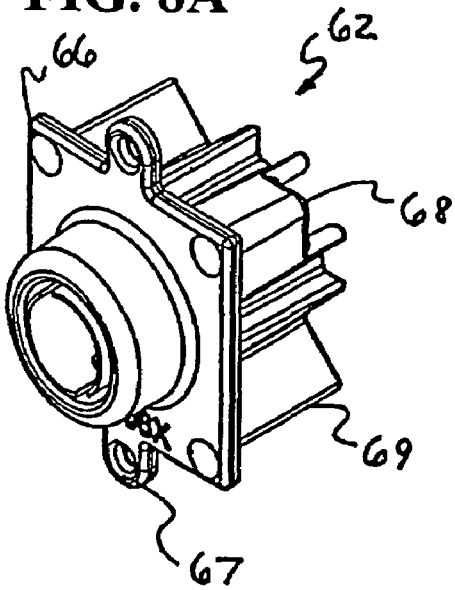
Figure 8B:
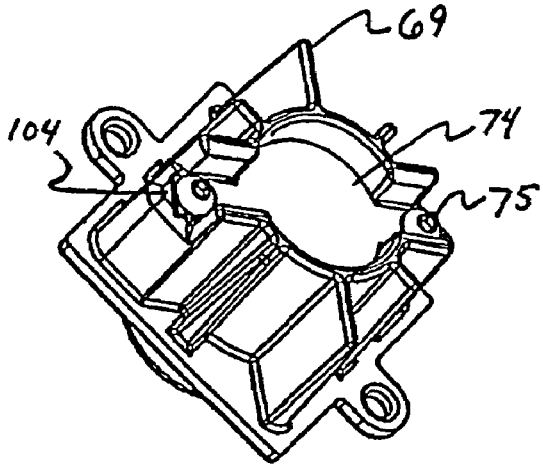
Figure 8C:
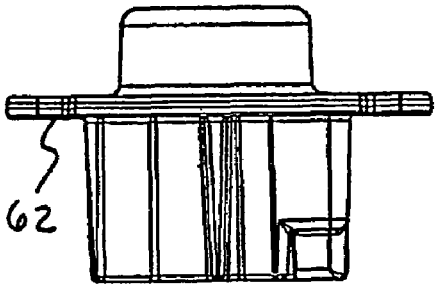
Figure 8D:
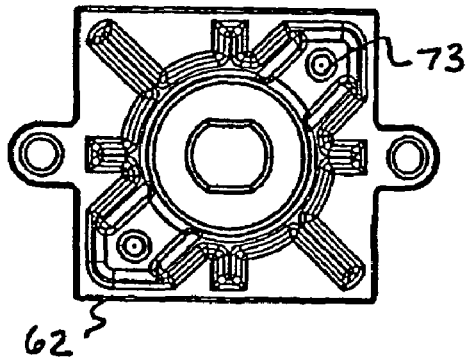
Figure 8E:
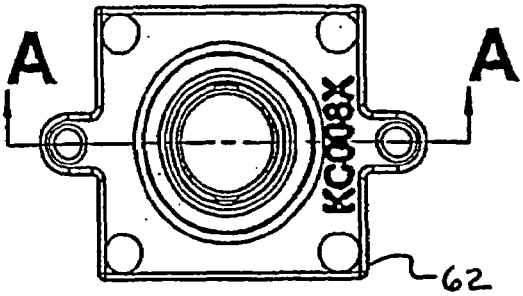
Figure 8F:
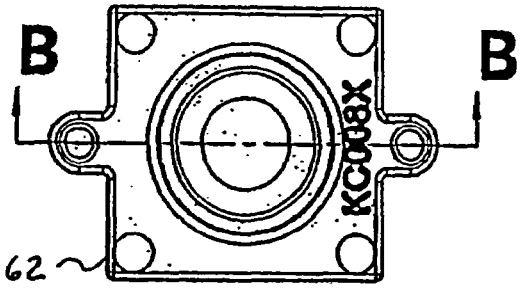
Figure 8G:
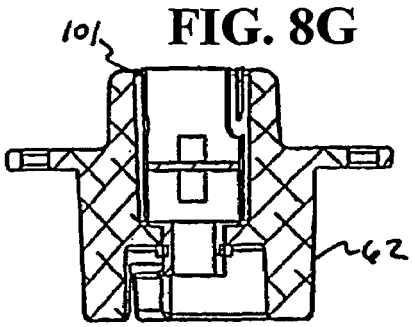
Figure 8H:
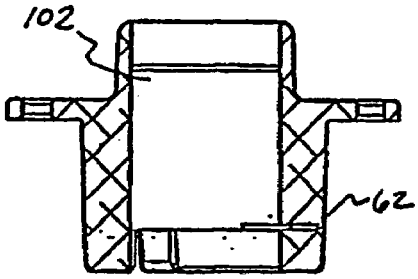
Figure 8I:
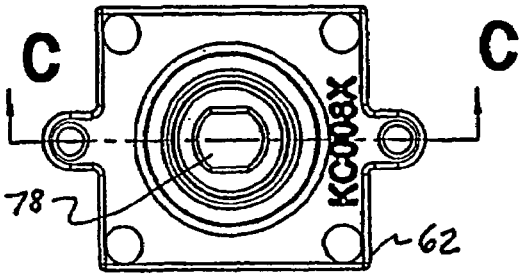

FIGS. 8A-8K show a lamp socket assembly 62, and some variations thereof, having a heat sinking ability and adapted for receiving a lamp 61. Socket assembly 62 is preferably formed by casting of a same type and material as is used to manufacture light support 34 and lamp housing 36, thereby effecting efficient heat transfer when such structures abut one another. Preferably, lamp socket assembly 62 has a shape and size to mate with lamp housing 36 in a manner that provides consistent lamp positioning and thermal conductivity for socket temperature management. FIGS. 8A-8B are perspective front and rear views, FIGS. 8E, 8G, and 8I are top views, and FIGS. 8C-8D respectively are side and bottom views of socket assembly 62. A top plate 66 of socket assembly 62 is formed with a shape suitable for enclosing a space between upper compartment 63 and the lower open dome portion of lamp housing 36. For example, top plate 66 is secured to integral screw bosses of lamp housing 36 with fasteners (not shown) via mounting holes 67. A base portion 68 extends into upper compartment 63 and provides heat radiating surface area by use of multiple fins 69. A mini-candelabra socket mounting plate 74 is secured to footings 104 with machine screws 75 being fastened into cored holes 73.

Figure 8J:
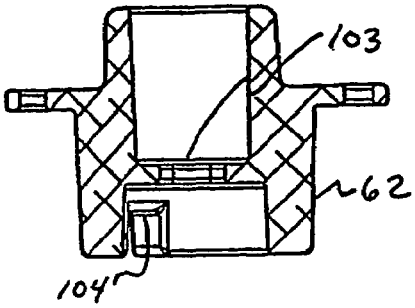
Figure 8K:
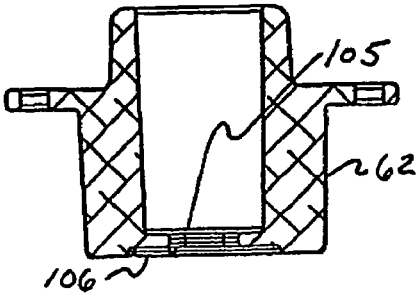

Socket mounting casting allows use of several different lamp bases by switching sockets in the casting 62. For example, DC bayonet, mini-candelabra, and others may be utilized, where positioning of integrated socket mounting positions allows for consistent lamp center location regardless of the particular base style used, thereby assuring consistency of optical performance and distribution. FIG. 8E shows a first type DC bayonet socket assembly that allows for anti-twist on a nipple mount socket where the bottom base level assures lamp position. FIG. 8F is a cutaway view along line A-A of FIG. 8E showing relative positioning of a DC bayonet socket 101, which mounts from the top (lamp) side of the casting 62. By comparison, FIG. 8G shows a mini-candelabra type socket assembly that mounts from the bottom side of the casting. FIG. 8H is a cutaway view along line B-B of FIG. 8G, showing an exemplary mini-candelabra socket 102. FIG. 8I shows an elongated double D hole 78 that allows for an anti-rotation mount with a nipple mounted DC bayonet socket. FIGS. 8J and 8K are each cutaway views along line C-C of FIG. 8I, where FIG. 8J shows an exemplary socket mount casting for a 250 Watt T4 quartz incandescent lamp, where a DC bayonet socket bottom base level 103 is provided for a top mount DC bayonet socket, and where a mini-candelabra socket footing level 104 is provided for a bottom mount mini-candelabra socket. FIG. 8K shows an exemplary socket mount casting for a 500 Watt T4 quartz incandescent lamp, where internal base 105 and bottom footing 106 are shifted down, for example, approximately 0.550 inch to accommodate the larger 500 Watt lamp.

A flowchart for a relamping method 160 according to an exemplary embodiment of the invention is shown in FIG. 9. As for most electrical maintenance, it is advisable to remove electrical power to the fixture beforehand, shown at step 161. At step 162, a maintenance worker approaches fixture 1 from a position above, for example on a catwalk. At step 163, the worker grasps handle 140 firmly and at step 164 the worker abruptly twists handle 140 in a counter-clockwise direction, which causes locking boss 122 to break free from leaf spring end 153, which allows lamp housing 36 to rotate. The rotation of lamp housing 36 is stopped by abutment of extending portion 157 of lamp housing 36 and an end of protrusion 42. A symmetrical extending portion is preferably formed on an opposite side of perimeter 124 for like abutment with an end of projection 43, and a locking stop assembly 41 is preferably structured the same as assembly 40 for engagement of a locking boss 122 on an opposite side of perimeter 124. The preferred embodiment requires a snapping sort of motion for the breaking free of the lock between locking boss 122 and leaf spring end 153. At step 165, the worker lifts lamp housing 36 slightly so that lower surface 133 clears the top of projection 42. Then, at step 166 the worker slides lamp housing 36 laterally until it is free from light support 34. Conduit 71 and any other attachments to lamp housing 36 act as umbilical cords that allow the worker to, for example, lay housing 36 on its side to access lamps 61, 65 and other hardware disposed within housing 36. At step 167, the worker removes a burned-out lamp and installs a new lamp and performs any other maintenance at step 168. At step 169, the worker holds housing 36 in its normal upright orientation using handle 140, and then slides lamp housing 36 laterally into respective entry portions 154 of assemblies 40, 41, where bottom surface 133 of lamp housing 36 clears the top of projection 42. Perimeter portion 124 becomes seated, at step 170, when it is contained within the area bounded by projections 42, 43, so that flat surface 133 abuts surface 45 of top 31 of light support 34. With a sort of snapping twisting motion, the worker rotates handle 140 clockwise to lock boss(es) 122 into engagement with leaf spring end(s) 153, thereby completing the re-assembly and re-lamping of fixture 1 at step 171. At step 172, electrical power is re-applied.

While the principles of the invention have been shown and described in connection with specific embodiments, it is to be understood that such embodiments are by way of example and are not limiting. Consequently, variations and modifications commensurate with the above teachings, and with the skill and knowledge of the relevant art, are within the scope of the present invention. The embodiments described herein are intended to illustrate best modes known of practicing the invention and to enable others skilled in the art to utilize the invention in such, or other embodiments and with various modifications required by the particular application(s) or use (s) of the present invention. It is intended that the appended claims be construed to include alternative embodiments to the extent permitted by the prior art.

What is claimed is:

1. A lighting fixture, comprising:

a base having a hole in a top surface thereof;

a lamp housing having a top portion and a dome-shaped bottom portion, the bottom portion including a perimeter flange portion having an essentially planar annular end surface sized to surround the hole, the perimeter flange portion resting on the top surface of the base surrounding the hole;

at least one boss extending substantially vertically from the perimeter flange portion of the lamp housing:

at least one retaining member disposed on the top surface of the base proximate the hole and structured for receiving the boss; and means for rotating the lamp housing, thereby effecting twist-locking attachment/detachment of the lamp housing to/from the base by rotating the boss into/out of engagement with the retaining member.

2. The lighting fixture of claim 1, wherein the retaining member comprises urging means for urging the annular end surface of the lamp housing against the top surface of the base.

3. The lighting fixture of claim 1, further comprising a reflector disposed in the lamp housing.

4. The lighting fixture of claim 1, wherein the base includes at least one curved guide disposed on the top surface and structured to maintain concentricity between the lamp housing and the hole as the lamp housing is rotated.

5. The lighting fixture of claim 4, wherein the perimeter portion includes a laterally extending section for inhibiting further rotation by abutment with the curved guide.

6. The lighting fixture of claim 1, wherein the retaining member includes a flat spring adapted to be deformed by engagement with the boss.

7. The lighting fixture of claim 1, wherein the base and the lamp housing are each cast metal.

8. The lighting fixture of claim 1, wherein the lamp housing includes at least one lamp socket and at least one corresponding conduit fitting adapted for directly receiving and securing a conduit proximate the lamp socket.

9. The lighting fixture of claim 1, wherein the lamp housing includes a primary lamp socket located t a center of the lamp housing and includes a primary lamp socket access chamber located above the primary lamp socket.

10. The lighting fixture of claim 1. wherein the base and the lamp housing are each cast metal, and wherein the primary lamp socket has a cast metal heat dissipation portion adapted to fit within the primary lamp socket access chamber.

11. The lighting fixture of claim 1, wherein the means for rotating the lamp housing comprise a handle attached to the top portion of the lamp housing.

12. The lighting fixture of claim 1, wherein the means for rotating the lamp housing comprise a tool attachment member disposed on the lamp housing and a tool adapted for securely engaging the tool attachment member, so that rotation of the tool effects the rotating of the lamp housing.

13. The lighting fixture of claim 1, wherein the means for rotating the lamp housing comprise a grip-able surface on the dome shaped bottom portion of the lamp housing.

14. A method of servicing a lighting fixture, comprising:

providing a base having a hole in a top surface thereof;

providing a lamp housing having a longitudinal axis, a top portion and a dome-shaped bottom portion. the bottom portion including a perimeter portion having an essentially planar annular end surface sized to surround the hole;

providing at least one boss extending from the perimeter portion of the lamp housing;

providing at least one retaining member disposed on the top surface of the base proximate the hole and structured for receiving the boss with the annular end surface of the lamp housing abutting the top surface of the base and surrounding the hole; and rotating the lamp housing about its longitudinal axis, thereby rotating the boss into or out of engagement with the retaining member and effecting twist-locking attachment/detachment of the lamp housing to/from the base.

15. The method of claim 14, wherein the lamp housing includes a lamp installed therein, the method further comprising:

lifting the lamp housing; and relamping the lamp, from a user position above the lighting fixture.

16. A method of relamping a lighting fixture, comprising:

providing a base having a hole in a top surface thereof;

providing a lamp housing with a bottom surface that rests on the top surface of the base and surrounds the hole, the lamp housing having a top portion and a handle secured to the top portion, the lamp housing having a socketed lamp disposed therein:

providing a twist-lock apparatus for rotatably locking the lamp housing to the base;

twisting the handle counter-clockwise, thereby unlocking the lamp housing from the base;

lifting the lamp housing by the handle and positioning the lamp housing so that the lamp may be accessed from a user position above the top surface of the base;

replacing the lamp;

lowering the lamp housing having a replaced lamp onto the base using the handle; and twisting the handle clockwise, thereby locking the lamp housing to the base.

17. The method of claim 16, further comprising providing structure for urging the lamp housing against the base when locking the lamp housing.

18. A lighting fixture, comprising:

a base having a hole in a top surface thereof;

a lamp housing having a top portion and a dome-shaped bottom portion, the bottom portion including a perimeter portion having an essentially planar annular end surface sized to surround the hole;

at least one boss extending from the perimeter portion of the lamp housing;

at least one retaining member disposed on the top surface of the base proximate the hole and structured for receiving the boss with the annular end surface of the lamp housing abutting the top surface of the base and surrounding the hole, the retaining member having a flat spring adapted to be deformed by engagement with the boss; and means for rotating the lamp housing, thereby effecting twist-locking attachment/detachment of the lamp housing to/from the base by rotating the boss into/out of engagement with the retaining member.

19. A lighting fixture, comprising:

a base having a hole in a top surface thereof;

a lamp housing having a top portion and a dome-shaped bottom portion, the bottom portion including a perimeter portion having an essentially planar annular end surface sized to surround the hole, the lamp housing further having a primary lamp socket positioned at a center of the lamp housing and a primary lamp socket access chamber positioned above the lamp socket;

at least one boss extending from the perimeter portion of the lamp housing;

at least one retaining member disposed on the top surface of the base proximate the hole and structured for receiving the boss with the annular end surface of the lamp housing abutting the top surface of the base and surrounding the hole; and means for rotating the lamp housing, thereby effecting twist-locking attachment/detachment of the lamp housing to/from the base by rotating the boss into/out of engagement with the retaining member.

20. The lighting fixture of claim 19, wherein the base and the lamp housing are each cast metal and wherein the primary lamp socket has a cast metal heat dissipation portion adapted to fit within the primary lamp socket access chamber.

* * * * *